US008464638B2

(12) United States Patent
Whitelaw et al.

(10) Patent No.: US 8,464,638 B2
(45) Date of Patent: Jun. 18, 2013

(54) PRINTING PRESS WITH CYLINDER SENSOR

(75) Inventors: Gordon Whitelaw, Bilgola (AU); Thomas Haecker, Marienfield (DE); Wolfgang Brusdeilins, Bielefeld (DE)

(73) Assignee: Bobst Bielefeld GmbH, Bielefeld (DE)

( * ) Notice: Subject to any disclaimer, the term of this patent is extended or adjusted under 35 U.S.C. 154(b) by 475 days.

(21) Appl. No.: 12/745,280

(22) PCT Filed: Dec. 9, 2008

(86) PCT No.: PCT/EP2008/010450

§ 371 (c)(1), (2), (4) Date: May 28, 2010

(87) PCT Pub. No.: WO2009/074295

PCT Pub. Date: Jun. 18, 2009

(65) Prior Publication Data

US 2010/0313775 A1 Dec. 16, 2010

(30) Foreign Application Priority Data

Dec. 11, 2007 (DE) ..... 10 2007 059 507

(51) Int. Cl.
*B41F 33/00* (2006.01)

(52) U.S. Cl.
USPC ..... 101/483; 101/248; 101/485

(58) Field of Classification Search
USPC ..... 101/483
See application file for complete search history.

(56) References Cited

U.S. PATENT DOCUMENTS

| | | | | |
|---|---|---|---|---|
| 5,492,062 | A * | 2/1996 | Harris et al. | 101/486 |
| 5,832,829 | A | 11/1998 | Kolbe et al. | |
| 6,802,659 | B2 * | 10/2004 | Cremon et al. | 400/76 |
| 6,832,866 | B2 * | 12/2004 | Klinefelter et al. | 101/483 |
| 7,308,854 | B2 * | 12/2007 | Rossini et al. | 101/483 |
| 2008/0141886 | A1 * | 6/2008 | Whitelaw et al. | 101/484 |

FOREIGN PATENT DOCUMENTS

| | | | |
|---|---|---|---|
| EP | 0226554 | A1 | 6/1987 |
| EP | 1733876 | A | 12/2006 |
| EP | 1834771 | A | 9/2007 |
| EP | 1916102 | A | 4/2008 |
| WO | 02/092344 | A | 11/2002 |

* cited by examiner

*Primary Examiner* — Jill Culler
(74) *Attorney, Agent, or Firm* — Richard M. Goldberg

(57) ABSTRACT

A printing press includes at least one exchangeable cylinder (10, 12) that is rotatably supported in a machine frame, a movable bearing member (18) forming part of a bearing (44) for the exchangeable cylinder (12), and a sensor head (26, 28, 30) that is capable of receiving signals from a signalling device (22, 24, 32) that is mounted on one of the cylinders (10, 12) of the printing press, and the sensor head (26, 28, 30) is mounted on the movable bearing member (18) and is arranged to receive the signals from a signalling device (22, 24, 32) at least when the bearing member (18) is in a predetermined position.

20 Claims, 4 Drawing Sheets

PRINTING PRESS WITH CYLINDER SENSOR

The invention relates to a printing press comprising at least one exchangeable cylinder that is rotatably supported in a machine frame, a movable bearing member froming part of a bearing for the exchangeable cylinder, and a sensor head that is capable of receiving signals from a signalling device that is mounted on one of the cylinders of the printing press.

The term "cylinder" is used here as a generic term for all cylinders and rollers of a rotary printing press and, accordingly, includes not only printing cylinders but also anilox rollers in a flexographic printing press, for example.

EP 1 834 771 A2 discloses a printing press of the type indicated above, wherein the angular position of the exchangeable cylinder can be detected by means of a sensor mounted on the machine frame and a position mark formed on the cylinder.

U.S. Pat. No. 5,832,829 A discloses a printing press, wherein a bearing at one end of the exchangeable cylinder can be withdrawn axially from a mandrel carrying this cylinder and can then be moved aside, so that the cylinder can be withdrawn axially from the mandrel. Instead of exchanging the cylinder itself, it is possible to exchange in a corresponding manner a sleeve that has been thrust onto the cylinder.

EP 1 916 102 A1 discloses a printing press wherein a cylinder has mounted thereon a signalling device that can be scanned or read by means of a sensor head mounted on the frame of the printing press.

It is an object of the invention to provide a printing press of this type wherein information on the exchangeable cylinder, for example information that is relevant for setting this cylinder in the printing press, can easily be read from the cylinder itself after the same has been mounted in the printing press.

According to the invention, in order to achieve this object, the sensor head is mounted on the movable bearing member and is arranged to receive the signals from a signalling device at least when the bearing member is in a predetermined position.

This arrangement of the sensor head permits to assure a good and reliable signal transmission between the signalling device and the sensor head while avoiding that the sensor head interferes with any other parts during operation of the printing press, during adjustment operations for the associated cylinder or during exchange of this cylinder.

The sensor head may for example be an RFID reader, when the signalling device at the cylinder is an RFID chip storing data on the geometry of the cylinder, for example.

However, the sensor head may also be a position sensor, when the signalling device on the cylinder is a position mark which permits an accurate detection of the side register and/or the actual angular position of the cylinder.

The cylinder the signalling device of which is read by means of the sensor head does not necessarily have to be supported in the bearing of which the bearing member carrying the sensor head forms part, but may for example be a neighbouring cylinder.

Useful embodiments and further developments of the invention are indicated in the dependent claims.

Preferably, the moveable bearing member carrying the sensor is rotatable about an axis that extends in parallel with the axis of the least one exchangeable cylinder or coincides therewith.

In an advantageous embodiment, the movable bearing member has associated therewith a position measuring device for measuring the position of this bearing member relative to another member of the printing press on which this bearing member is moveably supported. Said other member may for example be a bearing block that is displaceable relative to the machine frame for setting the printing cylinder against a central impression cylinder and for setting an anilox roller against the printing cylinder, respectively. When the exact position of the cylinder in the printing press shall be measured by means of the sensor head and the signalling device, the position measuring device provides, as additional information, the position of the movable bearing member relative to the bearing block, so that the position of the cylinder may exactly be determined also in relation to the bearing block.

In the preferred embodiment, the bearing member carrying the sensor head is also rotatable about the axis that is defined by the associated bearing, and as a result the sensor head can be tilted into a position in which it can read a signalling device, e.g., a position mark on a neighbouring cylinder.

If this neighbouring cylinder is additionally provided with an RFID chip, then the rotatable bearing member may comprise, in addition to the sensor head for detecting the position mark, a second sensor head in the form of an RFID reader. Preferably, the two sensor heads may then be brought alternatively into their operating positions by rotating the bearing member.

The bearing member may comprise yet another sensor head in the form of an RFID reader for reading an RFID chip of the cylinder that is supported in the bearing of which the movable bearing member forms part.

An embodiment example will now be explained in detail by reference to the drawings, wherein FIG. 1 is a schematic view of a printing cylinder and an anilox roller with an associated bearing member as seen from an operating side of the printing press;

Figure 1:
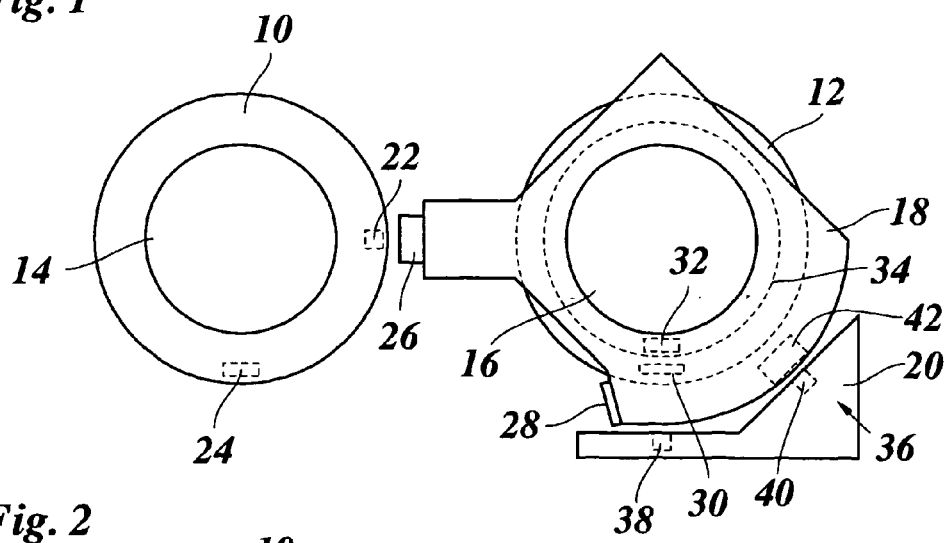

FIG. 1 shows an end view of a printing cylinder 10 and an anilox roller 12 of a flexographic printing press. The printing cylinder 10 is exchangeably mounted on a mandrel 14 both ends of which are rotatably supported in a frame of the printing press in bearings that have not been shown. Similarly, the anilox roller 12 is mounted on a mandrel 16. On the operating side of the printing press, the mandrel 16 is supported in a removable bearing of which FIG. 1 only shows a bearing member 18. A bracket 20 that is also visible in FIG. 1 forms part of the machine frame. The bearing member 18 is rotatable relative to the bracket 20 about the axis of the mandrel 16.

A printing cylinder 10 has a first signalling device which shall be designated as position mark 22 and is formed by a permanent magnet embedded in the peripheral surface of the printing cylinder.

In an other position of its periphery, the printing cylinder 10 is provided with a second signalling device formed by an RFID chip 24. This chip stores for example data on the geometry of the printing cylinder 10, which data have previously been measured with a suitable measuring device after the printing plates have been mounted on the printing cylinder but before the printing cylinder has been mounted in the printing press.

The movable bearing member 18 for the anilox roller 12 is provided with three sensor heads, i.e. a magnetic position sensor (hall sensor) 26 for detecting the position mark 22, an RFID reader 28 for reading the RFID chip 24, and another RFID reader 30 for reading an RFID chip 32 of the anilox roller 12.

The RFID chip 32 of the anilox roller 12 stores data on the geometry of this anilox roller. The geometry data stored on the RFID chips 24 and 32 are read by means of the associated readers 28 and 30, and the information thus obtained is used in a control system (not shown) of the printing press for adjusting the set position of the printing cylinder 10 and the anilox roller 12 in accordance with the specific geometry of these cylinders, so that occurrence of waste in a start-up phase of a print run is minimised, as has been described in detail in EP 1 916 102 A.

The RFID chip 32 of the anilox roller 12 is accommodated in a collar 34 at one end of this anilox roller, and the RFID reader 30 is arranged directly opposite to the peripheral portion of the collar 34 that contains the chip 32, so that, on each turn of the anilox roller, the chip will move past the reader with little distance, so that the data may be read wirelessly even when the anilox roller rotates.

Figure 2:
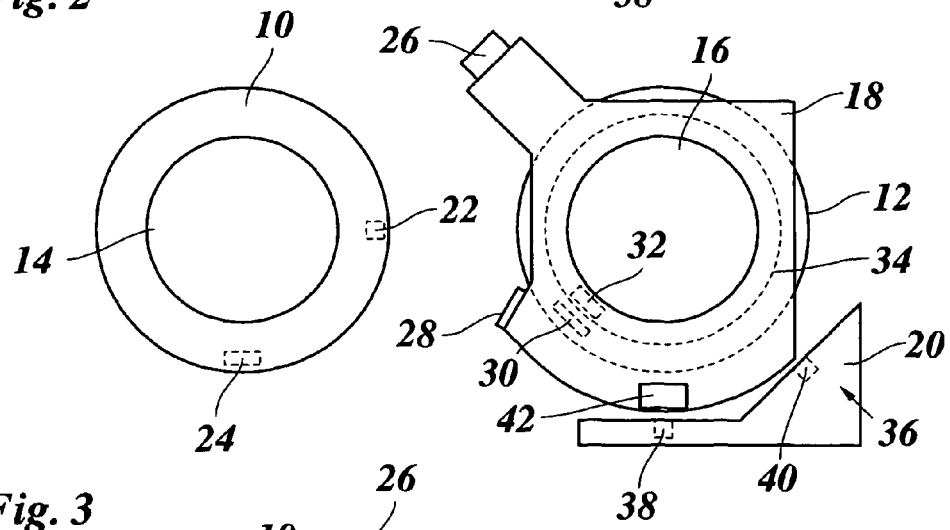
FIG. 2 is a view corresponding to FIG. 1 for another position of the bearing member.

In order for the RFID reader 28 to be able to read the data from the RFID chip 24 of the printing cylinder 10 in a corresponding way, the rotatable bearing member 18 must at first be rotated into the position shown in FIG. 2. Then, the entire anilox roller 12 including the associated bearing assembly is displaced, by means of servo-motor driven bearing blocks (not shown in FIGS. 1 to 3), into the position shown in FIG. 4 where the peripheral surfaces of the anilox roller 12 and printing cylinder 10 are almost in contact with one another. The RFID chip 24 may be read during a collision test which may for example be performed as follows: The printing cylinder 10 is driven by means of a drive system that has not been shown, and the anilox roller 12 is slowly displaced towards the printing cylinder. In the course of this process, the RFID reader 28 approaches the trajectory of the RFID chip 24, so that the contents of the latter can be read. As soon as the peripheral surface of the anilox roller 12 contacts the printing cylinder 10, the frictional contact will also start the non-driven anilox roller to move. This movement is detected and permits to determine with high sensitivity the position in which the anilox roller and the printing cylinder are just contacting one another.

Figure 3:
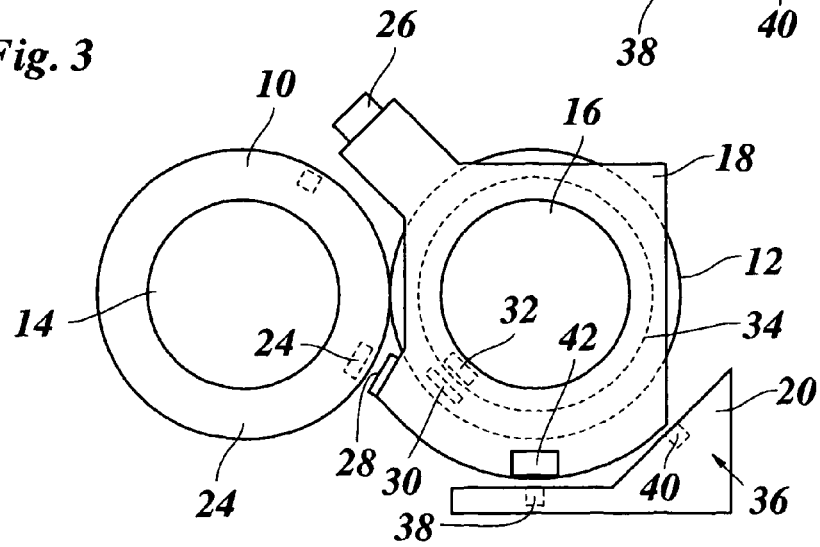
FIG. 3 is a view corresponding to FIG. 2 for a situation in which the anilox roller has been set against the printing cylinder.

The data from the RFID chip 32 may be read by means of the RFID reader 30 also in the positions shown in FIGS. 2 and 3.

The position mark 22 in the peripheral surface of the printing cylinder 10 is a magnetic signalling device the magnetic field of which is detected by the position sensor 26. Thus, the position of the mark 22 relative to the rotatable bearing member 18 may be determined with high accuracy, at least in two axes, i.e. in circumferential direction and axial direction of the printing cylinder 10, and preferably also in the third axis, i.e. the radial direction of the printing cylinder.

Exact knowledge of the position of the position mark 22 permits for example to precisely adjust the longitudinal register and the side register of the printing cylinder 10. If the geometry data stored on the chip 24 indicate a deviation of the peripheral surface of the printing cylinder 10 from the ideal circular shape, it is possible to determine, in conjunction with the information on the angular position of the printing cylinder as provided by the position mark 22, the posture of the peripheral surface of the printing cylinder in space with high accuracy.

However, the measurement of the position of the position mark 22 by means of the position sensor 26 still suffers from an uncertainty that may result from the fact that the position of the movable bearing member 18 itself is not accurately known. As will be explained later in greater detail, the bearing member 18 is not only rotatable about the axis of the mandrel 16 but is also movable relative the mandrel 16 and to the machine frame. For this reason, the bracket 20 has integrated therein a position measuring device 36 formed by two permanent magnets 38, 40 embedded in the bracket 20, and another magnet sensor (hall sensor) 42 is integrated in the bearing member 18. Similarly as the position sensor 26, the magnet sensor 42 is capable of detecting the relative position of the magnets 38 and 40 in at least two axes. Thus, when the bearing member 18 is in the angular position shown in FIG. 2 or 3, for example, the magnet 38 permits to control the axial position of the bearing member 18, and the angular position of the bearing member 18 is controlled by means of the magnet 40 in the position shown in FIG. 1.

Figure 4:
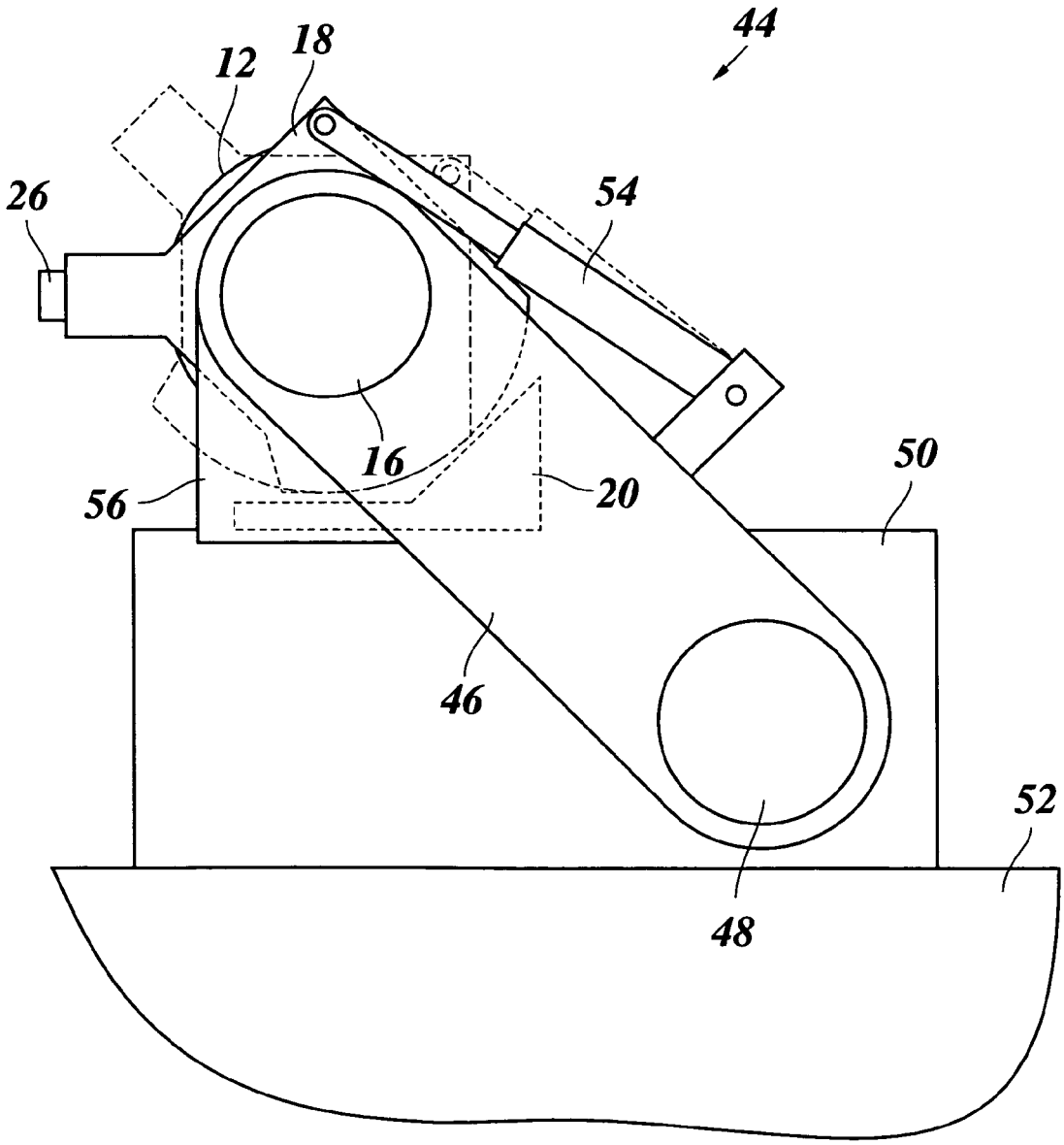
FIG. 4 is a view of the entire bearing for the anilox roller.

As has been shown in FIG. 4, the bearing member 18 for the anilox roller 12 forms part of a bearing 44 which also includes a bearing arm 46 that is tiltable about an axis 48 extending in parallel with the mandrel 16 and is held on a bearing block 50 so as to be slidable in axial direction. FIG. 4 further shows a part of a side frame 52 of the printing press on which the bearing block 50 is displaceable in horizontal direction so as to set the anilox roller 12 (together with a bearing block which has not been shown on the opposite side of the roller) against the printing cylinder 10

One end of the mandrel 16 of the anilox roller 12 is supported in the free end of the bearing arm 46. The bearing member 18 is in turn rotatably supported on the bearing arm 46, so that it can be rotated about the axis of the mandrel. An actuator 54, e.g., a pneumatic cylinder, serves for shifting the bearing member 18 between the position according to FIG. 1 (shown in continuous lines in FIG. 4) and the position according to FIG. 2 (shown in dashed lines in FIG. 4).

At its free end that accommodates the mandrel 16, the bearing arm 46 forms a slide socket 56 that is guided for sliding movement in axial direction of the mandrel 16. The bracket 20 is mounted on the bearing block 50 and is arranged behind the sliding socket 56 as seen in FIG. 4.

Figure 5:
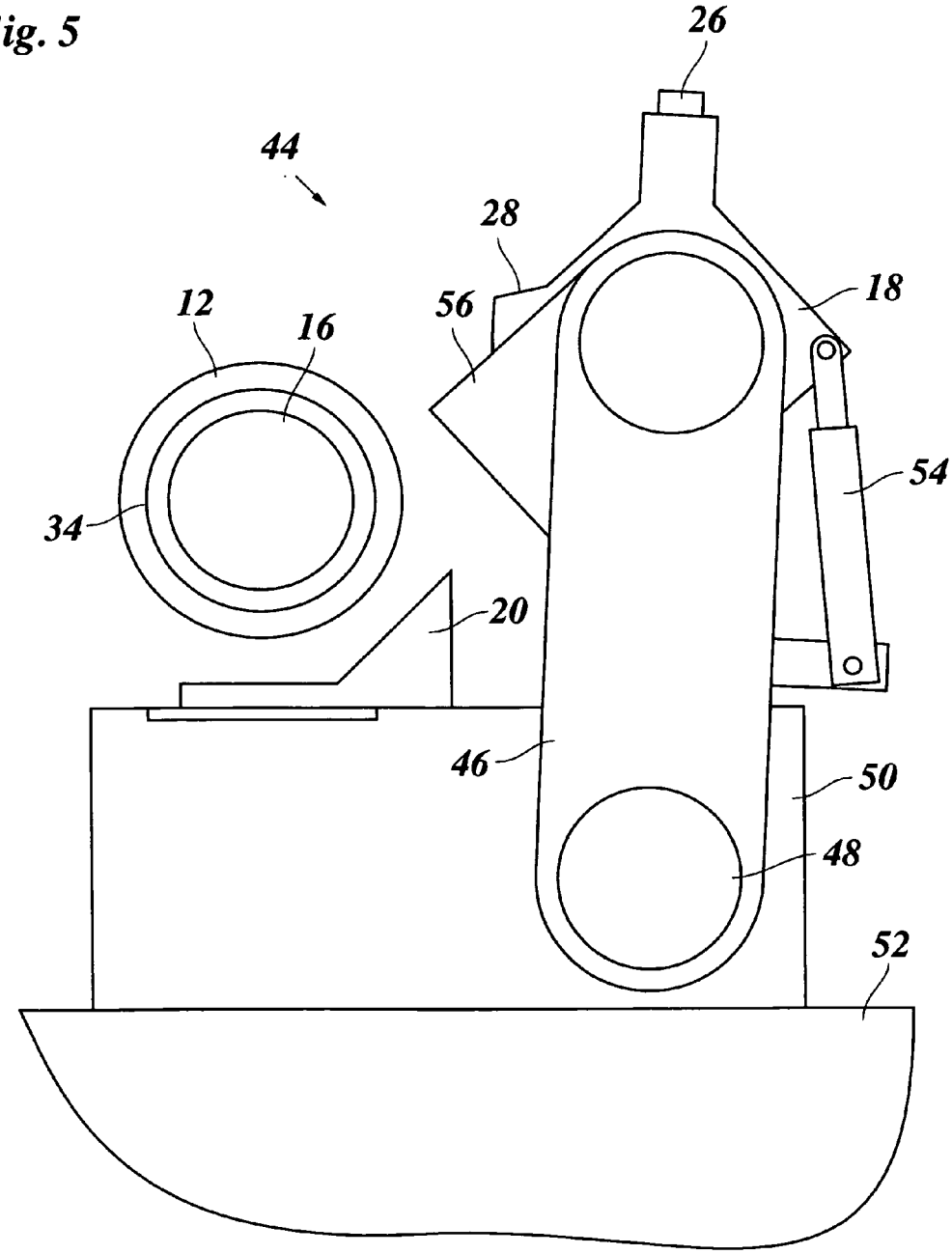
FIG. 5 shows the bearing of FIG. 4 in a tilted-away position.

When the anilox roller 12 is to be exchanged, the bearing arm 46 is axially drawn off from the end of the mandrel 16 together with the bearing member 18, until it may be tilted away about the axis 48. FIG. 5 shows the bearing 44 in a somewhat tilted position, so that the end of the anilox roller 12 is visible. The anilox roller is held in position because the end of the mandrel 16 is held in cantilever fashion in the machine frame on the side facing away from the viewer in FIG. 5. Then, the anilox roller 12 may axially be withdrawn from the mandrel 16.

Figure 6:
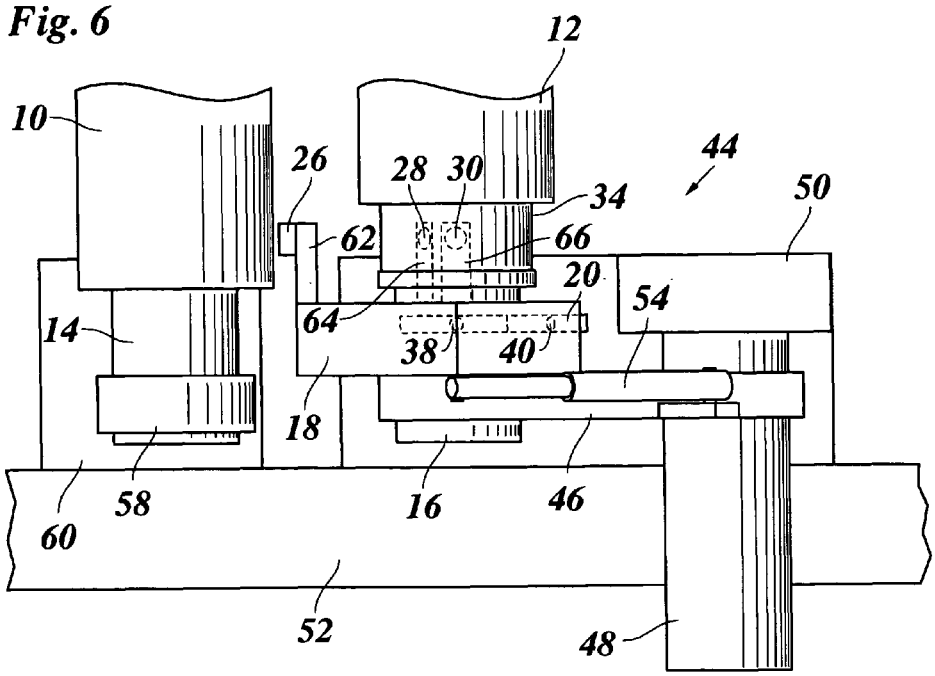
FIGS. 6 and 7 show bearing assemblies for the anilox roller and the printing cylinder on the operating side of the printing press in a plan view, for different positions of the bearing of the anilox roller.

FIG. 6 shows a top plan view of the bearing 44 in the condition according to FIG. 4. Moreover, the ends of the printing cylinder 10 and the mandrel 14 on the operating side of the machine have been shown as well as an associated bearing 58 that is held on the side frame 52 by means of a bearing block 60 that can be displaced independently of the bearing block 50.

The position sensor 26 is mounted on a holder 62 that projects axially from the bearing member 18. Similarly, the RFID readers 28 and 30 are mounted on holders 64 and 66 that project axially from the bearing member 18.

Figure 7:
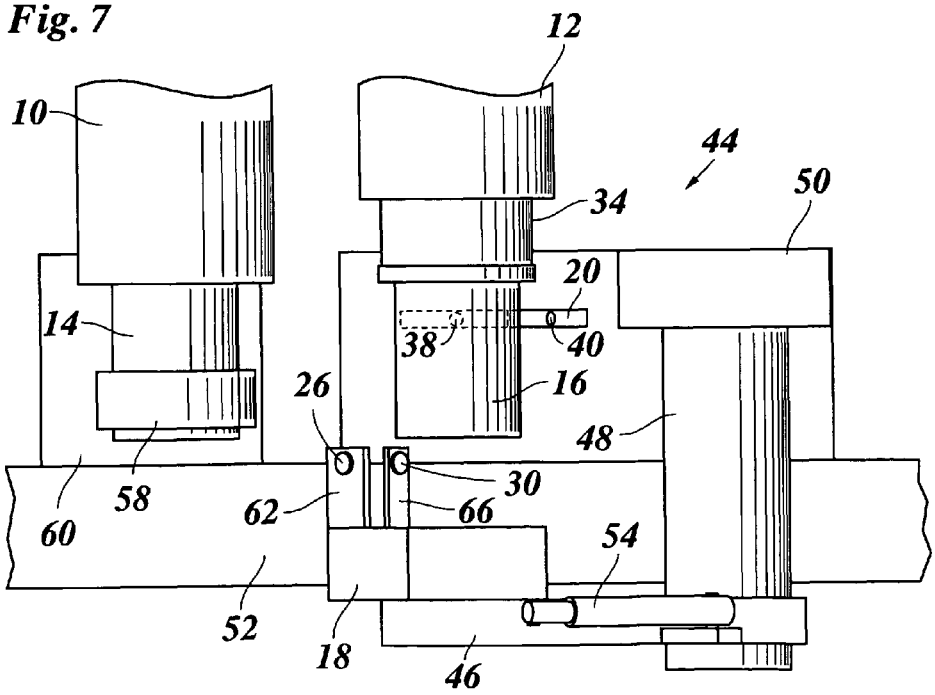

In FIG. 7, the bearing 44 has axially been drawn off from the mandrel 16 but has not yet been tilted away. Thanks to the axial draw-off movement, the bearing member 18 and the holders 62 and 64 release the mandrel 16, so that the bearing may be tilted into the position shown in FIG. 5. In FIG. 7, the bearing member 18 has been rotated into the position shown in FIG. 2, so that the RFID reader 28 and the holder 64 are hidden behind the holder 62.

What is claimed is:

1. A printing press comprising:

at least one exchangeable cylinder rotatably supported in a machine frame, a movable bearing member forming part of a bearing for supporting a first exchangeable cylinder of the at least one exchangeable cylinder, a signalling device mounted on one cylinder of said at least one exchangeable cylinder of the printing press, and at least one sensor head adapted to receive signals from the signalling device, the at least one sensor head being mounted on the movable bearing member and being arranged to receive the signals from the signalling device at least when the bearing member is in a predetermined position, wherein the at least one exchangeable cylinder has an axis, and the bearing member is rotatable about an axis that extends one of:

in parallel with, and coincides with the axis of said one cylinder containing said signalling device.

2. The printing press according to claim 1, wherein the bearing member is rotatable about an axis that is defined by the associated bearing.

3. The printing press according to claim 2, wherein the bearing member carries at least one said sensor head that is adapted to be, by rotating the bearing member, tilted into an active position in which the bearing member receives signals from the signalling device of said one cylinder.

4. The printing press according to claim 1, wherein the first exchangeable cylinder that is supported in the bearing associated with the bearing member includes an RFID chip as the signalling device, and the bearing member includes a corresponding RFID reader as one said sensor head.

5. The printing press according to claim 1, wherein:

the signalling device includes a position mark, one said associated sensor head includes a position sensor, and one of:

the movable bearing member and an associated component part has mounted thereon a position measuring device for measuring a position of the bearing member relative to said component part.

6. The printing press according to claim 5, wherein:

the first exchangeable cylinder has an axis, the bearing has a bearing arm carrying the bearing member, said bearing arm being slideable along an axis in parallel with the axis of said first exchangeable cylinder, and the position measuring device is arranged for measuring an axial position of the bearing member relative to the component part.

7. The printing press according to claim 6, wherein the bearing arm is tiltable about an axis that extends in parallel with the axis of the first exchangeable cylinder.

8. The printing press according to claim 5, wherein the position measuring device comprises at least one magnet and a corresponding magnet sensor.

9. A printing press comprising:

at least one exchangeable cylinder rotatably supported in a machine frame, a movable bearing member forming part of a bearing for supporting a first exchangeable cylinder of the at least one exchangeable cylinder, a signalling device mounted on one cylinder of said at least one exchangeable cylinder of the printing press, and at least one sensor head adapted to receive signals from the signalling device, the at least one sensor head being mounted on the movable bearing member and being arranged to receive the signals from the signalling device at least when the bearing member is in a predetermined position, wherein the bearing member carries two sensor heads which can alternatingly be tilted into an active position.

10. The printing press according to claim 9, wherein the first exchangeable cylinder that is supported in the bearing associated with the bearing member includes an RFID chip as the signalling device, and the bearing member includes a corresponding RFID reader as one said sensor head.

11. The printing press according to claim 9, wherein:

the signalling device includes a position mark, one said associated sensor head includes a position sensor, and one of:

the movable bearing member and an associated component part has mounted thereon a position measuring device for measuring a position of the bearing member relative to said component part.

12. The printing press according to claim 11 wherein:

the first exchangeable cylinder has an axis, the bearing has a bearing arm carrying the bearing member, said bearing arm being slideable along an axis in parallel with the axis of said first exchangeable cylinder, and the position measuring device is arranged for measuring an axial position of the bearing member relative to the component part.

13. The printing press according to claim 12, wherein the bearing arm is tiltable about an axis that extends in parallel with the axis of the first exchangeable cylinder.

14. The printing press according to claim 11, wherein the position measuring device comprises at least one magnet and a corresponding magnet sensor.

15. The printing press according to claim 9, wherein the bearing member carries at least one said sensor head that is adapted to be, by rotating the bearing member, tilted into an active position in which the bearing member receives signals from the signalling device of said one cylinder.

16. A printing press comprising:

at least one exchangeable cylinder rotatably supported in a machine frame, a movable bearing member forming part of a bearing for supporting a first exchangeable cylinder of the at least one exchangeable cylinder, a signalling device mounted on one cylinder of said at least one exchangeable cylinder of the printing press, and at least one sensor head adapted to receive signals from the signalling device, the at least one sensor head being mounted on the movable bearing member and being arranged to receive the signals from the signalling device at least when the bearing member is in a predetermined position, wherein:

the signalling device includes a position mark, one said associated sensor head includes a position sensor, and one of:

the movable bearing member and an associated component part has mounted thereon a position measuring device for measuring a position of the bearing member relative to said component part, and wherein the bearing member is rotatable, and the position measuring device is arranged for detecting an angular position of the bearing member relative to the component part.

17. The printing press according to claim 16, wherein:

the first exchangeable cylinder has an axis, the bearing has a bearing arm carrying the bearing member, said bearing arm being slideable along an axis in parallel with the axis of said first exchangeable cylinder, and the position measuring device is arranged for measuring an axial position of the bearing member relative to the component part.

18. The printing press according to claim 17, wherein the bearing arm is tiltable about an axis that extends in parallel with the axis of the first exchangeable cylinder.

19. The printing press according to claim 16, wherein the position measuring device comprises at least one magnet and a corresponding magnet sensor.

20. The printing press according to claim 16, wherein the bearing member carries at least one said sensor head that is adapted to be, by rotating the bearing member, tilted into an active position in which the bearing member receives signals from the signalling device of said one cylinder.

* * * * *